US011715901B2

(12) United States Patent
Matsuda

(10) Patent No.: US 11,715,901 B2
(45) Date of Patent: Aug. 1, 2023

(54) BOARD CONNECTOR

(71) Applicant: SUMITOMO WIRING SYSTEMS, LTD., Mie (JP)

(72) Inventor: Hidekazu Matsuda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 72 days.

(21) Appl. No.: 17/400,541

(22) Filed: Aug. 12, 2021

(65) Prior Publication Data

US 2022/0069504 A1 Mar. 3, 2022

(30) Foreign Application Priority Data

Aug. 27, 2020 (JP) ..... 2020-143816

(51) Int. Cl.
*H01R 12/71* (2011.01)
*H01R 13/422* (2006.01)
*H01R 12/57* (2011.01)

(52) U.S. Cl.
CPC ..... *H01R 13/422* (2013.01); *H01R 12/57* (2013.01); *H01R 12/716* (2013.01)

(58) Field of Classification Search
CPC .... H01R 13/422; H01R 12/57; H01R 12/716; H01R 12/712; H01R 13/41
See application file for complete search history.

(56) References Cited

U.S. PATENT DOCUMENTS

| | | | | |
|---|---|---|---|---|
| 7,179,094 | B2 | 2/2007 | Kawahara et al. | |
| 2015/0044901 | A1* | 2/2015 | Doi | H01R 12/716 439/592 |
| 2020/0052440 | A1* | 2/2020 | Hashiguchi | H01R 12/91 |
| 2020/0083643 | A1* | 3/2020 | Hashiguchi | H01R 13/41 |
| 2021/0098922 | A1* | 4/2021 | Phatiwuttipat | H01R 43/20 |
| 2021/0376510 | A1* | 12/2021 | Obata | H01R 12/91 |
| 2022/0069504 | A1* | 3/2022 | Matsuda | H01R 12/716 |
| 2022/0328991 | A1* | 10/2022 | Sawai | H05K 1/117 |

* cited by examiner

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A board connector A includes a housing 10 to be mounted on a circuit board P, and first and second terminal fittings 21, 31 mounted in the housing. The first and second terminal fittings 21, 31 include first and second board connecting portions 22, 32 projecting from a facing surface 15 of the housing 10 facing the circuit board P and to be surface-mounted on the circuit board P. The first and second board connecting portions 22, 32 extend in a direction intersecting a facing direction of the circuit board P and the facing surface 15. A jig accommodating portion 16 recessed from a region of the facing surface 15 not facing the first and second board connecting portions 22, 32 is formed in a region of the facing surface 15 facing the first and second board connecting portions 22, 32.

5 Claims, 5 Drawing Sheets

BOARD CONNECTOR

CROSS-REFERENCE TO RELATED APPLICATIONS

This application is based on and claims priority from Japanese Patent Application No. 2020-143816, filed on Aug. 27, 2020, with the Japan Patent Office, the disclosure of which is incorporated herein in their entireties by reference.

TECHNICAL FIELD

The present disclosure relates to a board connector.

BACKGROUND

Japanese Patent Laid-open Publication No. 2006-127974 discloses a SMT connector in which a plurality of contacts project in parallel from a facing surface of a housing facing a circuit board. A part of the contact projecting outside the housing is composed of a fixing portion to be fixed to the circuit board and a leg portion bent and disposed between the fixing portion and the housing.

SUMMARY

In the SMT connector of this type, the leg portions and the fixing portions are formed by bending the contacts after the contacts are press-fit into the housing. In forming the leg portion and the fixing portion, a jig is arranged in contact with the facing surface and the contact is bent in conformity with the shape of the jig. Since the jig is required to have rigidity against a bending force applied to the contact, a large thickness of the jig needs to be ensured. Since the jig is arranged between the facing surface of the housing and the leg portion, a board-side connector becomes bulky if an attempt is made to enhance the rigidity of the jig.

A board connector of the present disclosure was completed on the basis of the above situation and aims to reduce a height.

The present disclosure is directed to a board connector with a housing to be mounted on a circuit board, and a terminal fitting mounted in the housing, wherein the terminal fitting includes a board connecting portion projecting from a facing surface of the housing facing the circuit board and to be surface-mounted on the circuit board, the board connecting portion extends in a direction intersecting a facing direction of the circuit board and the facing surface, and a jig accommodating portion recessed from a region of the facing surface not facing the board connecting portion is formed in a region of the facing surface facing the board connecting portion.

According to the present disclosure, it is possible to reduce a height.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
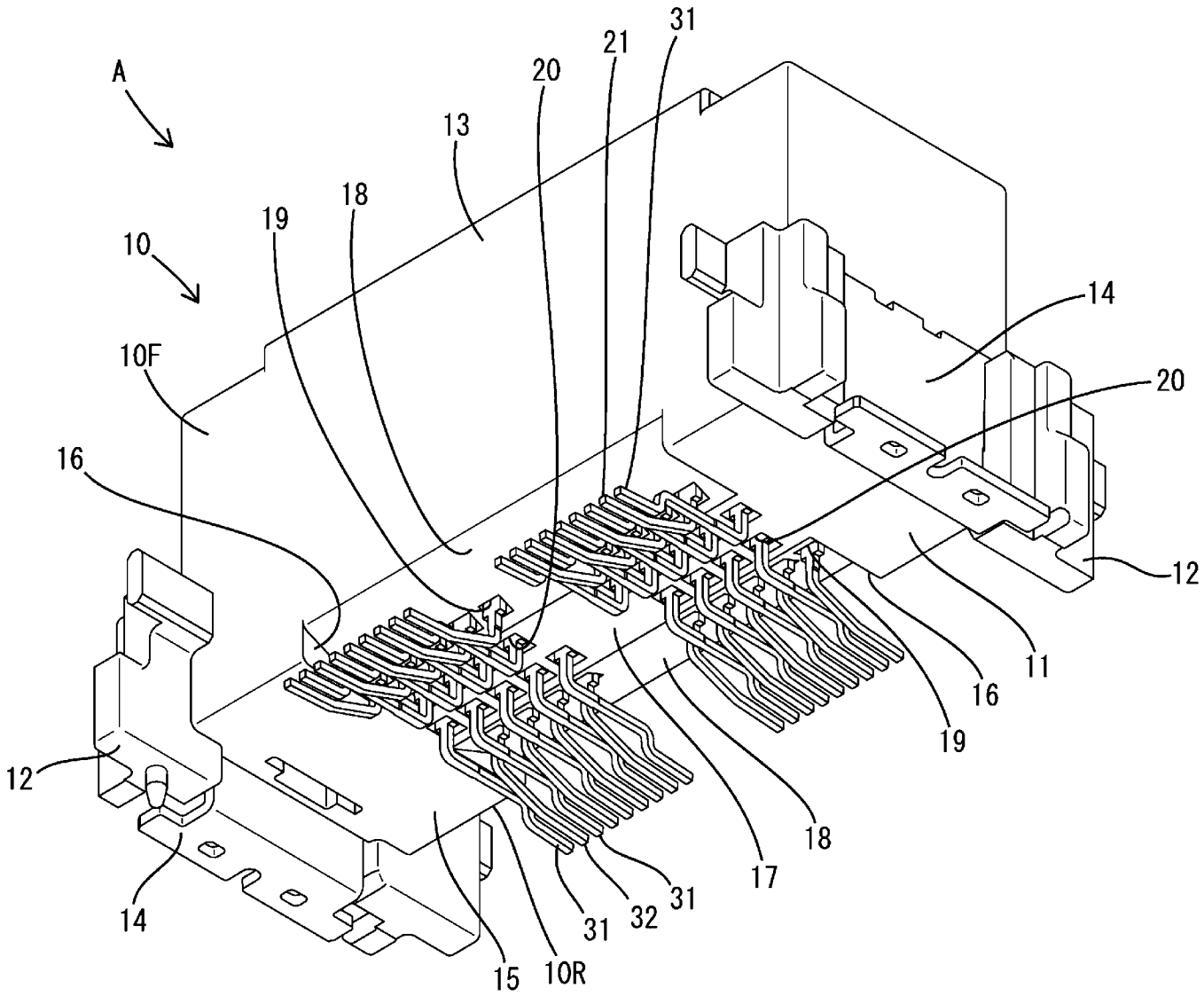
FIG. 1 is a perspective view of a board connector of one embodiment obliquely viewed from below.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The board connector of the present disclosure includes a housing to be mounted on a circuit board, and a terminal fitting mounted in the housing, wherein the terminal fitting includes a board connecting portion projecting from a facing surface of the housing facing the circuit board and to be surface-mounted on the circuit board, the board connecting portion extends in a direction intersecting a facing direction of the circuit board and the facing surface, and a jig accommodating portion recessed from a region of the facing surface not facing the board connecting portion is formed in a region of the facing surface facing the board connecting portion. According to the configuration of the present invention, in forming the board connecting portion, a jig is brought into contact with the jig accommodating portion and bends the terminal fitting along a forming surface of the jig facing the circuit board. The jig accommodating portion of the facing surface of the housing, with which the jig is brought into contact, is recessed from the region of the facing surface not facing the board connecting portion. Thus, even if a thickness of the jig is large in the facing direction of the housing and the circuit board, the board connecting portion can be arranged near the circuit board. Since the facing surface can be brought close to the circuit board in this way when the housing is mounted on the circuit board, the board connector of the present disclosure can be reduced in height.

(2) Preferably, a soldered portion to be conductively fixed to the circuit board is formed on an extending end part of the board connecting portion, and a depth of the jig accommodating portion is gradually increased from a projecting position of the board connecting portion in the facing surface toward the soldered portion. According to this configuration, the rigidity of the jig can be enhanced since a sufficiently large thickness can be ensured for a base end part of the jig.

(3) Preferably, the board connecting portion projects from the jig accommodating portion to outside of the housing. According to this configuration, the rigidity of the jig can be enhanced since the thickness of the jig can be increased over the entire jig.

(4) Preferably, the terminal fittings include first and second terminal fittings alternately arranged side by side in parallel to an outer side surface of the housing, a first board connecting portion, the first board connecting portion being the board connecting portion of the first terminal fitting, includes a first base portion projecting from the facing surface at a right angle to the circuit board and a first leg portion extending from a projecting end of the first base portion along the jig accommodating portion, a second board connecting portion, the second board connecting portion being the board connecting portion of the second terminal fitting, includes a second base portion projecting from the facing surface at a right angle to the circuit board and a second leg portion extending from a projecting end of the second base portion along the jig accommodating portion, the first base portion is arranged at a position closer to the outer side surface of the housing than the second base portion, and the first leg portion is arranged at a position more distant from the jig accommodating portion than the second leg portion in the facing direction of the facing surface and the circuit board. According to this configuration, since the second base portion is located backward of the first base portion when the first and second base portions are viewed from the outer side surface of the housing, there is a concern that a length of the second jig for forming the second leg portion is larger than that of a first jig for forming the first leg portion and the rigidity of the second jig is reduced. However, since the first leg portion is arranged at the position more distant from the jig accommodating portion than the second leg portion, the widthwise size of the second jig can be enhanced to correspond to the first leg portion. In this way, the rigidity of the second jig can be sufficiently enhanced.

Details of Embodiment of Present Disclosure

Embodiment

Figure 2:
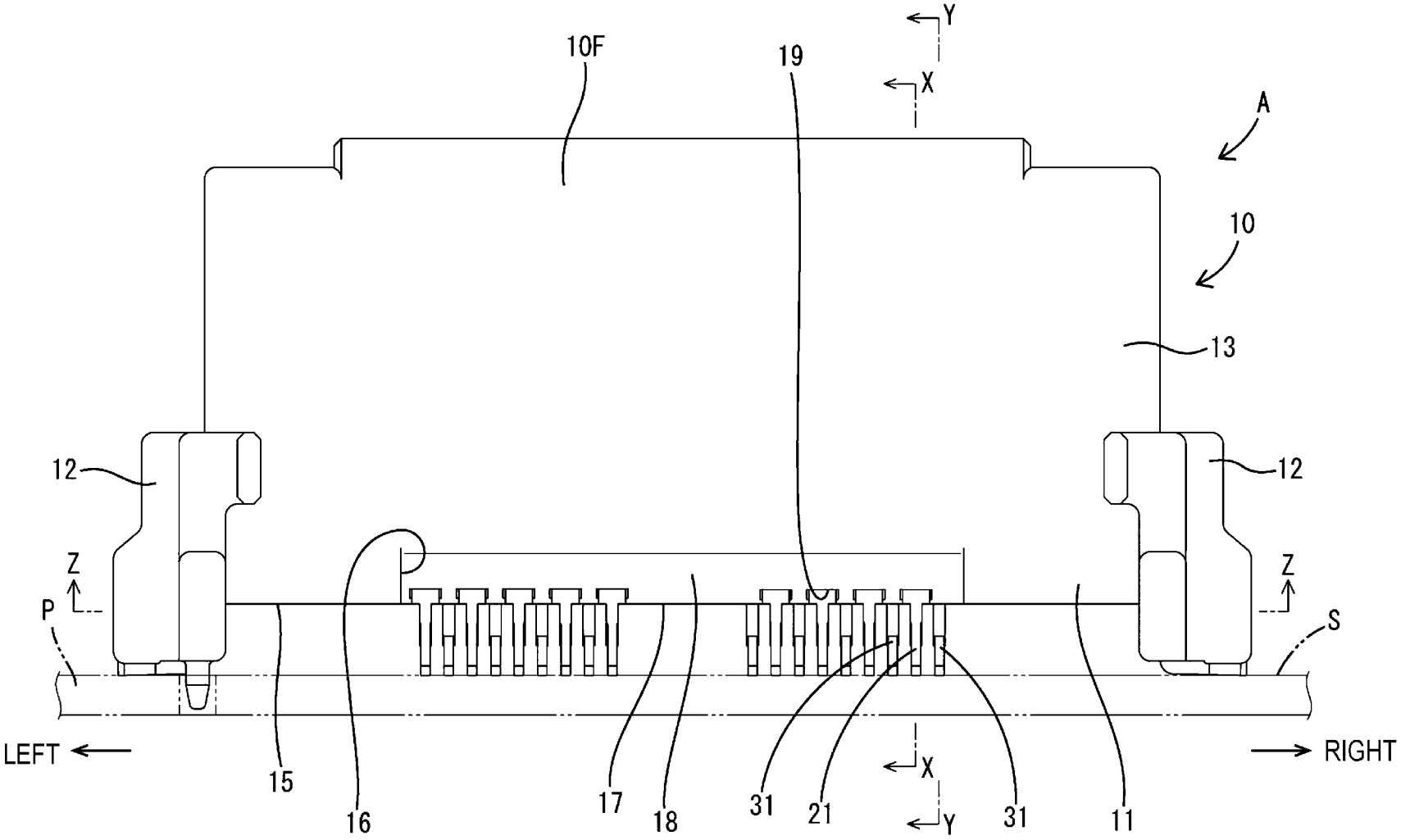
FIG. 2 is a front view of the board connector.
Figure 3:
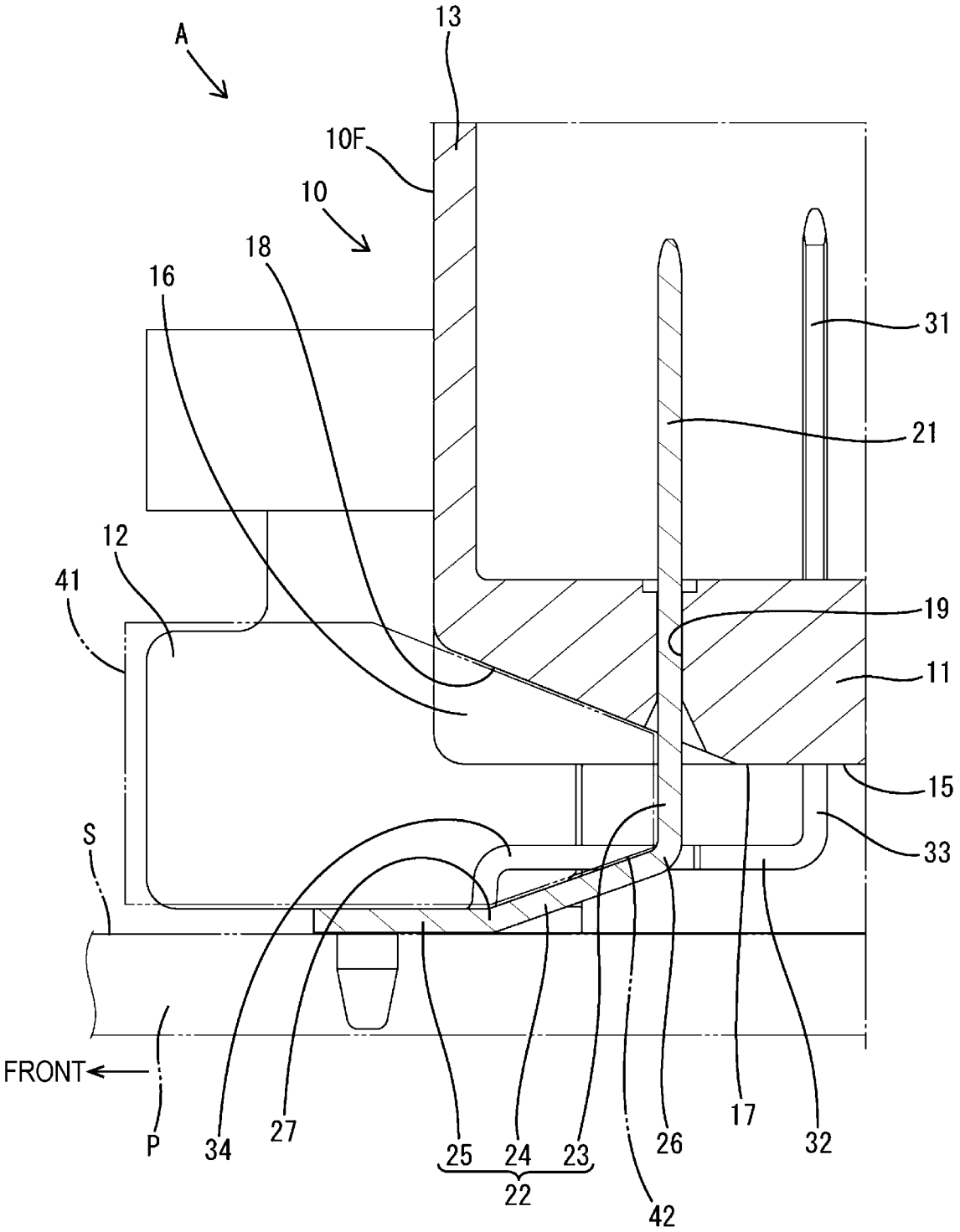
FIG. 3 is a section along X-X of FIG. 2.
Figure 4:
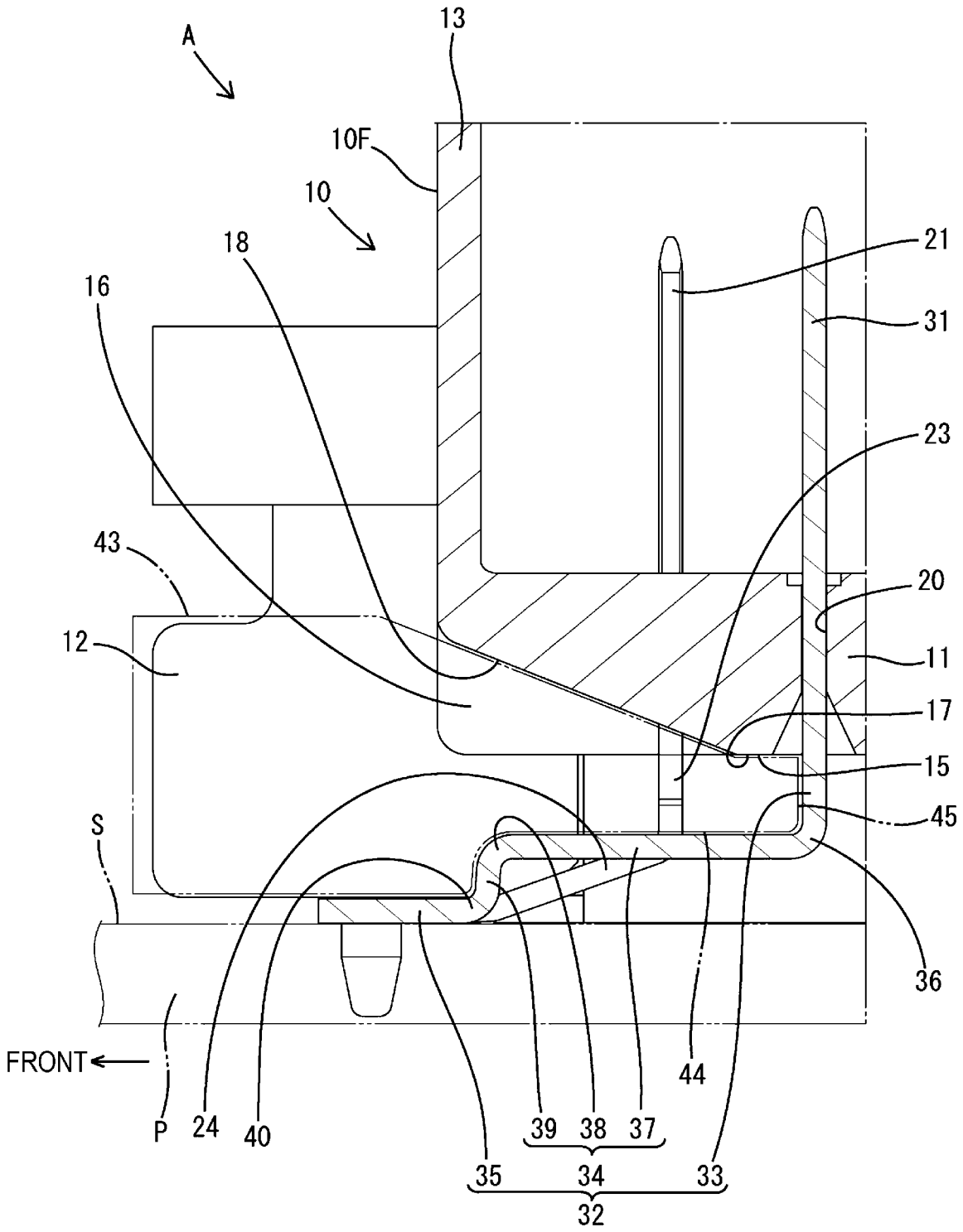
FIG. 4 is a section along Y-Y of FIG. 2.
Figure 5:
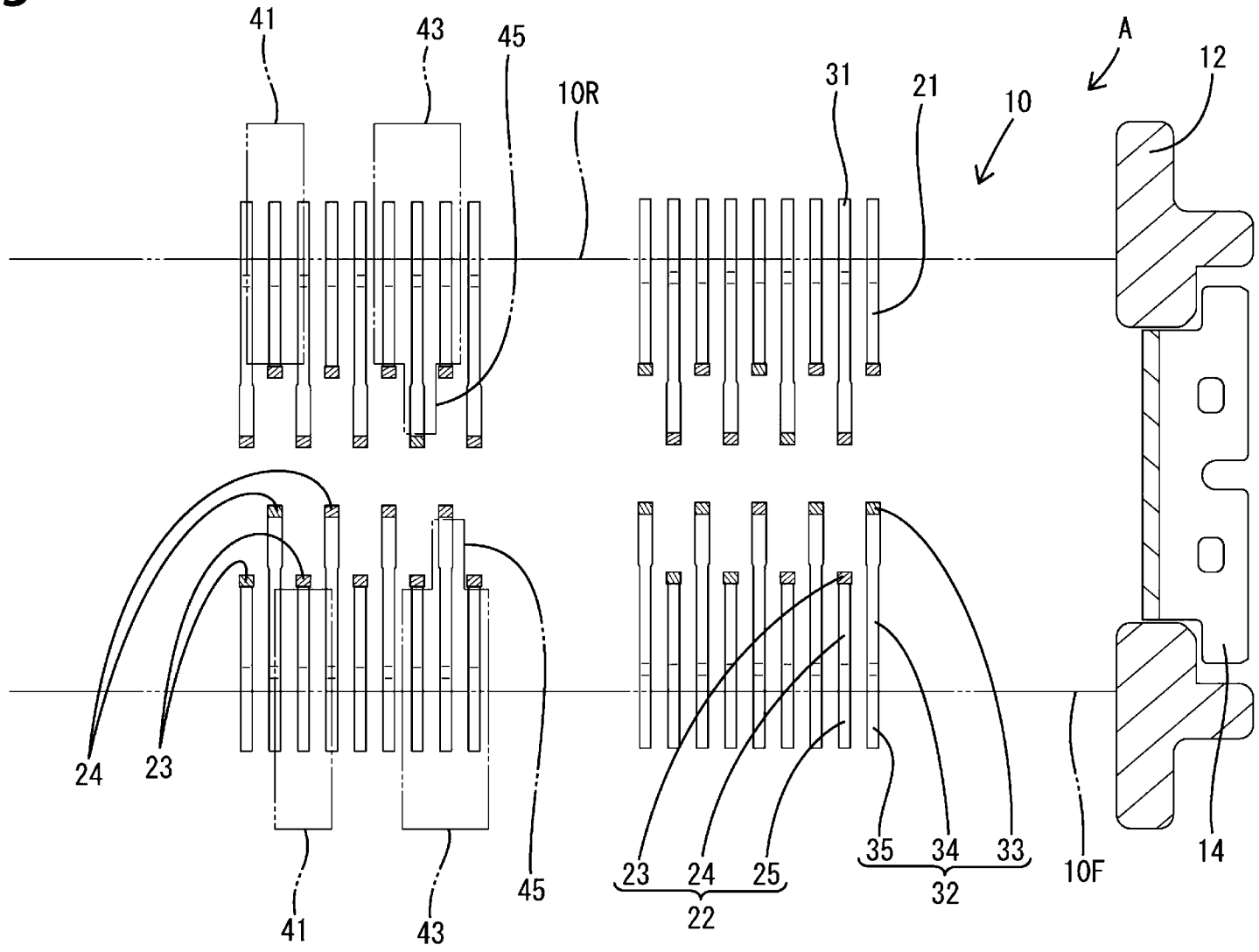
FIG. 5 is a section along Z-Z of FIG. 2.

One specific embodiment of a board connector of the present disclosure is described with reference to FIGS. 1 to 5. Note that the present invention is not limited to these illustrations and is intended to be represented by claims and include all changes in the scope of claims and in the meaning and scope of equivalents. In this embodiment, a left side in FIGS. 3 and 4 is defined as a front side concerning a front-rear direction. Upper and lower sides shown in FIGS. 1 to 4 are directly defined as upper and lower sides concerning a vertical direction. Left and right sides shown in FIGS. 2 and 5 are directly defined as left and right sides concerning a lateral direction.

A board connector A of this embodiment includes a housing 10 made of synthetic resin and to be mounted on a mounting surface S (upper surface) of a horizontally placed circuit board P, a plurality of first terminal fittings 21 symmetrically mounted in the housing 10 in the front-rear direction, and a plurality of second terminal fittings 31 symmetrically mounted in the housing 10 in the front-rear direction.

As shown in FIGS. 1 to 4, the housing 10 is a single component including a terminal holding portion 11 parallel to the mounting surface S of the circuit board P, a pair of board fixing portions 12 and a receptacle 13. The pair of board fixing portions 12 project toward the circuit board P (downward) from both left and right end parts of the terminal holding portion 11 and are fixed to the mounting surface S of the circuit board P via pegs 14. The receptacle 13 projects toward a side (upper side) opposite to the circuit board P from the outer peripheral edge of the terminal holding portion 11.

The lower surface of the terminal holding portion 11 serves as a facing surface 15 vertically facing the mounting surface S of the circuit board P. In a bottom view of the housing 10, the facing surface 15 has a rectangular shape having long sides extending in the lateral direction. The facing surface 15 is formed with a pair of jig accommodating portions 16 symmetrical in the front-rear direction. A formation range of the jig accommodating portions 16 in the lateral direction is a region of the facing surface 15 except both left and right end parts. A formation range of the jig accommodating portions 16 in the front-rear direction is a region of the facing surface 15 except a central part in the front-rear direction. The jig accommodating portions 16 have a rectangular bottom view shape having long sides extending in the lateral direction.

A region of the facing surface 15 except the jig accommodating portions 16 serves as a non-accommodating portion 17 H-shaped in a bottom view shape. The jig accommodating portions 16 are formed by recessing the facing surface 15 from the non-accommodating portion 17. The jig accommodating portions 16 are open in a front surface 10F and a rear surface 10R of the housing 10. As shown in FIGS. 3 and 4, the front jig accommodating portion 16 is recessed in a tapered manner and includes a jig contact portion 18 obliquely facing the circuit board P in a side cross-section of the housing 10. The jig contact portion 18 is formed by a flat surface inclined to gradually increase a facing interval to the circuit board P from a center in the front-rear direction of the housing 10 toward a front side. On a boundary between the rear end edge of the front jig accommodating portion 16 and the non-accommodating portion 17, the front jig contact portion 18 and the non-accommodating portion 17 are connected at an obtuse angle. Both left and right end parts of the front jig contact portion 18 and the non-accommodating portion 17 form steps via both left and right inner surfaces right triangular in a side view of the front jig accommodating portion 16.

The rear jig accommodating portion 16 also includes a jig contact portion 18 facing the circuit board P. This jig contact portion 18 is formed by a flat surface inclined to gradually increase a facing interval to the circuit board P from the center in the front-rear direction of the housing 10 toward a rear side. On a boundary between the rear end edge of the rear jig accommodating portion 16 and the non-accommodating portion 17, the rear jig contact portion 18 and the non-accommodating portion 17 are connected at an obtuse angle. Both left and right end parts of the rear jig contact portion 18 and the non-accommodating portion 17 form steps via both left and right inner surfaces right triangular in a side view of the rear jig accommodating portion 16.

As shown in FIGS. 1, 3 and 4, the terminal holding portion 11 is formed with a plurality of first press-fit holes 19 penetrating through the terminal holding portion 11 in the vertical direction, and a plurality of second press-fit holes 20 penetrating through the terminal holding portion 11 in the vertical direction. The first press-fit holes 19 are open at positions near the rear end edge of the front jig contact portion 18 and at positions near the front end edge of the rear jig contact portion 18. In each jig contact portion 18, the plurality of first press-fit holes 19 are linearly arranged at predetermined intervals in a row in the lateral direction (direction parallel to the front and rear end edges of the jig contact portion 18). The plurality of second press-fit holes 20 are open in a region of the non-accommodating portion 17 between the front and rear jig contact portions 18. The second press-fit holes 20 are separated in two front and rear rows and linearly arranged at predetermined intervals in a row in the lateral direction.

As shown in FIG. 1, in a region in front of the center in the front-rear direction of the housing 10, the plurality of first press-fit holes 19 open in the front jig contact portion 18 and the plurality of second press-fit holes 20 open on a side near the front jig contact portion 18 are arranged in a staggered manner in a bottom view. That is, in the front-rear direction, a distance from the front surface 10F (outer side surface) of the housing 10 to the first press-fit holes 19 is shorter than a distance from the front surface 10F of the housing 10 to the second press-fit holes 20, and the first and second press-fit holes 19, 20 are alternately arranged in the front-rear direction.

In a region behind the center in the front-rear direction of the housing 10, the plurality of first press-fit holes 19 open in the rear jig contact portion 18 and the plurality of second press-fit holes 20 open on a side near the rear jig contact portion 18 are arranged in a staggered manner in a bottom view. That is, in the front-rear direction, a distance from the rear surface 10R (outer side surface) of the housing 10 to the first press-fit holes 19 is shorter than a distance from the rear surface 10R of the housing 10 to the second press-fit holes 20, and the first and second press-fit holes 19, 20 are alternately arranged in the front-rear direction.

As shown in FIG. 3, the first terminal fitting 21 is made of a metal wire material elongated as a whole. The first terminal fitting 21 has a linear shape and is mounted into the terminal holding portion 11 by being press-fit into the first press-fit hole 19 from the side of the facing surface 15. A part of the first terminal fitting 21 projecting toward the facing surface 15 (circuit board P) from the terminal holding portion 11 functions as a first board connecting portion 22 to be connected to the mounting surface S of the circuit board P. The first board connecting portion 22 is formed into a predetermined shape by being bent using a first jig 41 (see FIG. 3) after being mounted into the terminal holding portion 11.

The first board connecting portion 22 includes a first base portion 23, a first leg portion 24 and a first soldered portion 25. The first base portion 23 is a part projecting from the first press-fit hole 19 toward the mounting surface S in a direction orthogonal to the non-accommodating portion 17. The first leg portion 24 of the first terminal fitting 21 arranged on a front side extends forward away from the first press-fit hole 19 via a first housing-side bent portion 26 having an obtuse angle from the projecting end of the first base portion 23. An extending direction of the first leg portion 24 is a direction oblique to a facing direction (vertical direction) of the housing 10 and the circuit board P and oblique to the mounting surface S (horizontal direction) of the circuit board P. The first leg portion 24 is facing the jig contact portion 18 in an oblique posture while being vertically spaced apart from the jig contact portion 18. The first soldered portion 25 extends in parallel to the mounting surface S in the same direction as the first leg portion 24 via a first board-side bent portion 27 having an obtuse angle from an extending end of the first leg portion 24. The first terminal fitting 21 arranged on a rear side is symmetrically shaped with the first terminal fitting 21 arranged on the front side in the front-rear direction.

As shown in FIG. 4, the second terminal fitting 31 is made of a metal wire material elongated as a whole. The second terminal fitting 31 has a linear shape and is mounted into the terminal holding portion 11 by being press-fit into the second press-fit hole 20 from the side of the facing surface 15. A part of the second terminal fitting 31 projecting toward the facing surface 15 (circuit board P) from the terminal holding portion 11 functions as a second board connecting portion 32 to be connected to the mounting surface S of the circuit board P. The second board connecting portion 32 is formed into a predetermined shape by being bent using a second jig 43 (see FIG. 4) after being mounted into the terminal holding portion 11.

The second board connecting portion 32 includes a second base portion 33, a second leg portion 34 and a second soldered portion 35. The second base portion 33 is a part projecting from the second press-fit hole 20 formed in the non-accommodating portion 17 toward the mounting surface S in a direction orthogonal to the non-accommodating portion 17. The second leg portion 34 arranged on a front side extends forward from a projecting end of the second base portion 33 via a second housing-side bent portion 36. The second leg portion 34 includes a horizontal portion 37, an intermediate bent portion 38 and a vertical portion 39. The horizontal portion 37 extends forward at a right angle from the projecting end of the second base portion 33 via the second housing-side bent portion 36. The horizontal portion 37 is parallel to the mounting surface S of the circuit board P and facing the non-accommodating portion 17 and the jig contact portion 18 while being vertically spaced apart from the non-accommodating portion 17 and the jig contact portion 18. The vertical portion 39 extends at a right angle from an extending end of the horizontal portion 37 toward the circuit board P via the intermediate bent portion 38. The second soldered portion 35 extends from an extending end of the second leg portion (vertical portion 39) in parallel to the mounting surface S in the same direction as an extending direction of the horizontal portion 37 via a second board-side bent portion 40. The second terminal fitting 31 arranged on the rear side is symmetrically shaped with the second terminal fitting 31 arranged on the front side in the front-rear direction.

In forming the first board connecting portion 22 on the side near the front surface 10F of the housing 10, the first jig 41 is moved from the side of the front surface 10F of the housing 10 toward the first terminal fitting 21 along the facing surface 15. Then, the tip surface of the first jig 41 is butted against a part of the first terminal fitting 21, which will become the first base portion 23, and the upper surface of the first jig 41 is brought into contact with the facing surface 15. The entire upper surface of the first jig 41 comes into surface contact with the jig accommodating portion 16 (jig contact portion 18) recessed upward from the non-accommodating portion 17 of the facing surface 15. In this state, the first terminal fitting 21 is bent along a first forming surface 42 on the lower surface of the first jig 41.

Here, a vertical positional relationship of the first leg portion 24 and the second leg portion 34 arranged on the side near the front surface 10F (outer side surface) of the housing 10 is described. As shown in FIGS. 3 and 4, the second leg portion 34 is arranged at a position closer to the facing surface 15 than the first leg portion 24. Thus, in bending the first and second board connecting portions 22, 32, the first board connecting portions 22 are first formed using the first jig 41. In the process of bending the first board connecting portions 22, the second terminal fittings 31 not formed with the second board connecting portions 32 yet are located backward of (at positions more distant from the front surface 10F of the housing 10 than) the first terminal fittings 21. Therefore, even if the wide first jig 41 is used, the first jig 41 and the second terminal fittings 31 do not interfere with each other.

After the first board connecting portions 22 are formed, the second board connecting portions 32 on the side near the front surface 10F of the housing 10 are formed. At this time, as in the case of the first board connecting portion 22, the second jig 43 is moved from the side of the front surface 10F of the housing 10 toward the second terminal fitting 31 along the facing surface 15, the tip surface of the second jig 43 is butted against a part of the second terminal fitting 31, which will become the second base portion 33, and the upper surface of the second jig 43 is brought into contact with the facing surface 15. A most region of the upper surface of the second jig 43 except a tip part 45 comes into surface contact with the jig accommodating portion 16 (jig contact portion 18) recessed upward from the non-accommodating portion 17 of the facing surface 15, similarly to the first jig 41. The tip part 45 of the upper surface of the second jig 43 comes into surface contact with the non-accommodating portion 17. In this state, the second terminal fitting 31 is bent along a second forming surface 44 on the lower surface of the second jig 43.

A positional relationship in the front-rear direction of the first base portion 23 and the second base portion 33 arranged on the side near the front surface 10F (outer side surface) of the housing 10 is described. As shown in FIGS. 3 and 4, the second base portion 33 is arranged at a position more distant from the front surface 10F of the housing 10 than the first base portion 23. Thus, a length in the front-rear direction of the second jig 43 is longer than that of the first jig 41. Moreover, since the tip part 45 of the second jig 43 is butted against the part, which is inserted between the first base portions 23 laterally adjacent to each other and will become the second base portion 33, a width in the lateral direction of the tip part 45 is small. Here, the already bent first leg portions 24 are arranged at positions more distant from the facing surface 15 than the second leg portions 34 to be bent. Thus, as shown in FIG. 5, a part of the second jig 43 closer to the front surface 10F of the housing 10 than the first base portion 23 can have a wide width. Therefore, the second jig 43 has a high rigidity as a whole. The first and second board connecting portions 22, 32 arranged on the side near the rear surface 10R of the housing 10 can also be bent in a manner similar to the above.

The board connector A of this embodiment includes the housing 10 to be mounted on the circuit board P and the first and second terminal fittings 21, 31 mounted in the housing 10. The first terminal fitting 21 includes the first board connecting portion 22 projecting from the facing surface 15 of the housing 10 facing the circuit board P and to be surface-mounted on the circuit board P. The first board connecting portion 22 extends from the first press-fit hole 19 toward the front or rear surface 10F, 10R of the housing 10 in a direction intersecting the facing direction of the circuit board P and the facing surface 15 (forward or rearward). The second terminal fitting 31 includes the second board connecting portion 32 projecting from the facing surface 15 of the housing 10 facing the circuit board P and to be surface-mounted on the circuit board P. The second board connecting portion 32 also extends from the second press-fit hole 20 toward the front or rear surface 10F, 10R of the housing 10 in the direction intersecting the facing direction of the circuit board P and the facing surface 15 (forward or rearward).

The facing surface 15 is formed with the jig accommodating portions 16. The formation range of the jig accommodating portion 16 is a region vertically facing the entire first board connecting portions 22, out of the facing surface 15, and includes a region vertically facing parts of the second board connecting portions 32 except base end parts near the second press-fit holes 20. A partial region of the jig accommodating portion 16 is not facing the first and second board connecting portions 22, 32. The jig accommodating portion 16 is recessed from the non-accommodating portion 17 of the facing surface 15. The non-accommodating portion 17 is a region not facing the entire first board connecting portions 22, out of the facing surface 15, facing the base end parts of the second board connecting portions 32 near the second press-fit holes 20 and not facing most parts of the second board connecting portions 32 except the base end parts near the second press-fit holes 20.

In forming the first board connecting portion 22, the first jig 41 is brought into contact with the jig accommodating portion 16 and bends the first terminal fitting 21 along the first forming surface 42 of the first jig 41 facing the circuit board P. In forming the second board connecting portion 32, the second jig 43 is brought into contact with the jig accommodating portion 16 and bends the second terminal fitting 31 along the second forming surface 44 of the second jig 43 facing the circuit board P. Out of the facing surface 15 of the housing 10, the jig accommodating portion 16, with which the first and second jigs 41, 43 are brought into contact, is formed by recessing the facing surface 15 from the non-accommodating portion 17. Thus, even if thicknesses of the first and second jigs 41, 43 in the facing direction of the housing 10 and the circuit board P are large, the first and second board connecting portions 22, 32 can be arranged near the housing 10. In this way, the facing surface 15 can be brought close to the circuit board P when the housing 10 is mounted on the circuit board P. Therefore, the board connector A of this embodiment can be reduced in height by as much as the pair of front and rear jig accommodating portions 16 are formed.

The first soldered portion 25 to be conductively fixed to the circuit board P is formed on an extending end part of the first board connecting portion 22. The second soldered portion 35 to be conductively fixed to the circuit board P is formed on an extending end part of the second board connecting portion 32. A vertical depth of the jig accommodating portion 16 is gradually increased from the projecting positions (first press-fit holes 19) of the first board connecting portions 22 in the facing surface 15 toward the first soldered portions 25 and gradually increased from the projecting positions (second press-fit holes 20) of the second board connecting portions 32 in the facing surface 15 toward the second soldered portions 35. According to this configuration, sufficiently large thicknesses can be ensured for a base end part of the first jig 41 and a base end part of the second jig 43, wherefore the rigidity of the first and second jigs 41, 43 can be enhanced.

The first board connecting portions 22 project from the first press-fit holes 19 of the jig accommodating portion 16 toward the outside of the housing 10. Since the thickness of the first jig 41 can be increased over the entirety of the first jig 41, the rigidity of the first jig 41 can be enhanced.

The terminal fittings to be mounted into the housing 10 include the plurality of first terminal fittings 21 and the plurality of second terminal fittings 31 alternately arranged side by side in the lateral direction in parallel to the outer side surfaces (front surface 10F and rear surface 10R) of the housing 10. The first board connecting portion 22 of the first terminal fitting 21 includes the first base portion 23 projecting from the facing surface 15 at a right angle to the circuit board P and the first leg portion 24 extending from the projecting end of the first base portion 23 along the jig accommodating portion 16. The second board connecting portion 32 of the second terminal fitting 31 includes the second base portion 33 projecting from the facing surface 15 at a right angle to the circuit board P and the second leg portion 34 extending from the projecting end of the second base portion 33 along the jig accommodating portion 16. The first base portion 23 is arranged at the position closer to the front or rear surface 10F, 10R of the housing 10 than the second base portion 33. In the facing direction of the facing surface 15 and the circuit board P, the first leg portion 24 is arranged at the position more distant from the jig accommodating portion 16 than the second leg portion 34.

According to this configuration, when the first and second base portions 23, 33 are viewed from the front or rear surface 10F, 10R of the housing 10, the second base portions 33 are located backward of the first base portions 23. Thus, there is a concern that a length of the second jig 43 for forming the second leg portions 34 is longer than that of the first jig 41 for forming the first leg portions 24 to reduce the rigidity of the second jig 43. However, since the first leg portions 24 are arranged at the positions more distant from the jig accommodating portion 16 than the second leg portions 34, the widthwise size of the second jig 43 can be enlarged to correspond to the first leg portions 24. In this way, the rigidity of the second jig 43 can be sufficiently enhanced.

Other Embodiments of Present Disclosure

The present invention is not limited to the above described and illustrated embodiment, but is represented by claims. The present invention is intended to include all changes in the scope of claims and in the meaning and scope of equivalents and also include the following embodiments.

Although the depth of the jig accommodating portion is gradually increased from the projecting positions of the board connecting portions in the facing surface toward the soldered portions in the above embodiment, the depth of the jig accommodating portion may be constant from the projecting positions of the board connecting portions in the facing surface to the soldered portions.

Although the first terminal fittings are caused to project from the jig accommodating portions and the second terminal fittings are caused to project from regions different from the jig accommodating portions in the above embodiment, both the first and second terminal fittings may be caused to project from the jig accommodating portions or both the first and second terminal fittings may be caused to project from regions other than the jig accommodating portions.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A board connector, comprising:

a housing to be mounted on a circuit board; and a terminal fitting mounted in the housing, wherein:

the terminal fitting includes a board connecting portion projecting from a facing surface of the housing facing the circuit board and to be surface-mounted on the circuit board, the board connecting portion extends in a direction intersecting a facing direction of the circuit board and the facing surface, a jig accommodating portion recessed from a region of the facing surface not facing the board connecting portion is formed in a region of the facing surface facing the board connecting portion, and the board connecting portion extends from a projecting position of the board connecting portion in the facing surface along the jig accommodating portion.

2. The board connector of claim 1, wherein:

a soldered portion to be conductively fixed to the circuit board is formed on an extending end part of the board connecting portion, and a depth of the jig accommodating portion is gradually increased from the projecting position of the board connecting portion in the facing surface toward the soldered portion.

3. The board connector of claim 1, wherein the board connecting portion projects from the jig accommodating portion to outside of the housing.

4. The board connector of claim 1, wherein:

the terminal fittings include first and second terminal fittings alternately arranged side by side in parallel to an outer side surface of the housing, a first board connecting portion, the first board connecting portion being the board connecting portion of the first terminal fitting, includes a first base portion projecting from the facing surface at a right angle to the circuit board and a first leg portion extending from a projecting end of the first base portion along the jig accommodating portion, a second board connecting portion, the second board connecting portion being the board connecting portion of the second terminal fitting, includes a second base portion projecting from the facing surface at a right angle to the circuit board and a second leg portion extending from a projecting end of the second base portion along the jig accommodating portion, the first base portion is arranged at a position closer to the outer side surface of the housing than the second base portion, and the first leg portion is arranged at a position more distant from the jig accommodating portion than the second leg portion in the facing direction of the facing surface and the circuit board.

5. The board connector of claim 4, wherein a formation range of the jig accommodating portion includes a region vertically facing the entire first board connecting portion, out of the facing surface, and a region vertically facing parts of the second board connecting portion except the projecting end of the second base portion.

* * * * *